US008596292B2

(12) United States Patent
Maier

(10) Patent No.: US 8,596,292 B2
(45) Date of Patent: Dec. 3, 2013

(54) FLUSH-ENABLED CONTROLLED FLOW DRAIN

(75) Inventor: William C. Maier, Almond, NY (US)

(73) Assignee: Dresser-Rand Company, Olean, NY (US)

( * ) Notice: Subject to any disclaimer, the term of this patent is extended or adjusted under 35 U.S.C. 154(b) by 0 days.

(21) Appl. No.: 13/522,208

(22) PCT Filed: Aug. 22, 2011

(86) PCT No.: PCT/US2011/048652

§ 371 (c)(1),
(2), (4) Date: Sep. 20, 2012

(87) PCT Pub. No.: WO2012/033632

PCT Pub. Date: Mar. 15, 2012

(65) Prior Publication Data

US 2013/0160876 A1 Jun. 27, 2013

Related U.S. Application Data

(60) Provisional application No. 61/381,423, filed on Sep. 9, 2010.

(51) Int. Cl.

| | |
|---|---|
| ***E03B 3/40*** | (2006.01) |
| ***B01D 45/16*** | (2006.01) |
| ***B01D 45/18*** | (2006.01) |
| ***B01D 21/26*** | (2006.01) |
| ***C02F 1/38*** | (2006.01) |

(52) U.S. Cl.

USPC ..... 137/204; 137/546; 137/561 R; 55/459.2; 55/459.4; 210/512.1; 210/787; 95/271; 96/215

(58) Field of Classification Search

USPC ..... 137/204, 13, 561 R, 544, 545, 546; 55/459.2, 459.4; 210/512.1, 787; 96/215; 95/271

See application file for complete search history.

(56) References Cited

U.S. PATENT DOCUMENTS

| | | | |
|---|---|---|---|
| 815,812 | A | 3/1906 | Gow |
| 1,057,613 | A | 4/1913 | Baldwin |

(Continued)

FOREIGN PATENT DOCUMENTS

| | | |
|---|---|---|
| AU | 2005282269 | 9/2005 |
| AU | 2010202069 | 6/2010 |

(Continued)

OTHER PUBLICATIONS

Bi-Phase Rotary Separator Turbine, Multiphase Power & Processing Technologies LLC Technical literature (available at http://www.mpptech.com/techppp/pdfs/Bi-Phase.pdf).

(Continued)

*Primary Examiner* — Craig Schneider
*Assistant Examiner* — Atif Chaudry
(74) *Attorney, Agent, or Firm* — Edmonds & Nolte, PC

(57) ABSTRACT

A controlled flow drain having an upper flange coupled to a lower flange. The upper flange defines an inlet cavity and the lower flange defines a swirl chamber. The inlet cavity and swirl chamber are in fluid communication via a swirl nozzle defined within a swirl nozzle plate that separates the inlet cavity from the swirl chamber. After separating debris within the drain fluid, the drain fluid is accelerated through the swirl nozzle and discharged into the swirl chamber, and more debris is thereby separated and eventually settles into an annular groove. The drain fluid may then exit the lower flange via an exit control passage. The swirl chamber may be flushed with a series of flushing liquid injection ports symmetrically-arrayed about the annular groove. Flushing the swirl chamber removes fluidized debris and also remove any built up fouling present on the swirl nozzle and exit control passage.

16 Claims, 3 Drawing Sheets

(56) References Cited

U.S. PATENT DOCUMENTS

| | | | | |
|---|---|---|---|---|
| 1,061,656 | A | | 5/1913 | Black |
| 1,480,775 | A | | 1/1924 | Marien |
| 1,622,768 | A | | 3/1927 | Cook |
| 1,642,454 | A | | 9/1927 | Malmstrom |
| 2,006,244 | A | | 6/1935 | Kopsa |
| 2,300,766 | A | | 11/1942 | Baumann |
| 2,328,031 | A | | 8/1943 | Risley |
| 2,345,437 | A | | 3/1944 | Tinker |
| 2,347,939 | A | | 5/1944 | Down |
| 2,383,244 | A | | 8/1945 | Farmer |
| 2,720,313 | A | | 12/1951 | Pattison |
| 2,602,462 | A | | 7/1952 | Barrett |
| 2,743,865 | A | | 5/1956 | Graae |
| 2,811,303 | A | | 10/1957 | Ault |
| 2,836,117 | A | | 5/1958 | Lankford |
| 2,868,565 | A | | 1/1959 | Suderow |
| 2,897,917 | A | | 8/1959 | Hunter |
| 2,932,360 | A | | 4/1960 | Hungate |
| 2,954,841 | A | | 10/1960 | Reistle |
| 2,955,673 | A | | 10/1960 | Kennedy |
| 3,044,657 | A | | 7/1962 | Horton |
| 3,093,467 | A | * | 6/1963 | McLaughlin ..... 96/408 |
| 3,175,572 | A | | 3/1965 | Kauer |
| 3,191,364 | A | | 6/1965 | Sylvan |
| 3,198,214 | A | | 8/1965 | Lorenz |
| 3,204,696 | A | | 9/1965 | De Priester |
| 3,213,794 | A | | 10/1965 | Adams |
| 3,220,245 | A | | 11/1965 | Van Winkle |
| 3,273,325 | A | | 9/1966 | Gerhold |
| 3,341,111 | A | | 9/1967 | Sanders |
| 3,352,577 | A | | 11/1967 | Medney |
| 3,395,511 | A | | 8/1968 | Ernst |
| 3,402,434 | A | | 9/1968 | Swearingen |
| 3,431,747 | A | | 3/1969 | Hasheimi |
| 3,454,163 | A | | 7/1969 | Read |
| 3,487,432 | A | | 12/1969 | Jenson |
| 3,490,209 | A | | 1/1970 | Fernandes |
| 3,500,614 | A | | 3/1970 | Soo |
| 3,548,568 | A | | 12/1970 | Carlson, Jr. |
| 3,578,342 | A | | 5/1971 | Satterthwaite et al. |
| 3,628,812 | A | | 12/1971 | Larraide et al. |
| 3,646,727 | A | | 3/1972 | Wachsmuth |
| 3,672,733 | A | | 6/1972 | Arsenius |
| 3,694,103 | A | | 9/1972 | Cohen |
| 3,810,347 | A | | 5/1974 | Kartinen |
| 3,814,486 | A | | 6/1974 | Schurger |
| 3,829,179 | A | | 8/1974 | Kurita |
| 3,915,673 | A | | 10/1975 | Tamai |
| 3,973,930 | A | | 8/1976 | Burgess |
| 3,975,123 | A | | 8/1976 | Schibbye |
| 4,033,647 | A | | 7/1977 | Beavers |
| 4,043,353 | A | | 8/1977 | Shirey |
| 4,059,364 | A | | 11/1977 | Anderson |
| 4,078,809 | A | | 3/1978 | Garrick |
| 4,087,261 | A | | 5/1978 | Hays |
| 4,103,899 | A | | 8/1978 | Turner |
| 4,112,687 | A | | 9/1978 | Dixon |
| 4,117,359 | A | | 9/1978 | Wehde |
| 4,135,542 | A | | 1/1979 | Chisholm |
| 4,141,283 | A | | 2/1979 | Swanson |
| 4,146,261 | A | | 3/1979 | Edmaier |
| 4,165,622 | A | | 8/1979 | Brown, Jr. |
| 4,174,925 | A | | 11/1979 | Pfenning |
| 4,182,480 | A | | 1/1980 | Theyse |
| 4,197,990 | A | | 4/1980 | Carberg |
| 4,205,927 | A | | 6/1980 | Simmons |
| 4,227,373 | A | | 10/1980 | Amend |
| 4,258,551 | A | | 3/1981 | Ritzi |
| 4,259,045 | A | | 3/1981 | Teruyama |
| 4,278,200 | A | | 7/1981 | Gunnewig |
| 4,298,311 | A | | 11/1981 | Ritzi |
| 4,303,372 | A | | 12/1981 | Caffrey |
| 4,333,748 | A | | 6/1982 | Erickson |
| 4,334,592 | A | | 6/1982 | Fair |
| 4,336,693 | A | | 6/1982 | Hays |
| 4,339,923 | A | | 7/1982 | Hays |
| 4,347,900 | A | | 9/1982 | Barrington |
| 4,363,608 | A | | 12/1982 | Mulders |
| 4,374,583 | A | | 2/1983 | Barrington |
| 4,375,975 | A | | 3/1983 | McNicholas |
| 4,382,804 | A | | 5/1983 | Mellor |
| 4,384,724 | A | | 5/1983 | Derman |
| 4,391,102 | A | | 7/1983 | Studhalter |
| 4,396,361 | A | | 8/1983 | Fraser |
| 4,432,470 | A | | 2/1984 | Sopha |
| 4,438,638 | A | | 3/1984 | Hays |
| 4,441,322 | A | | 4/1984 | Ritzi |
| 4,442,925 | A | | 4/1984 | Fukushima et al. |
| 4,453,893 | A | | 6/1984 | Hutmaker |
| 4,453,894 | A | | 6/1984 | Ferone |
| 4,463,567 | A | | 8/1984 | Amend |
| 4,468,234 | A | | 8/1984 | McNicholas |
| 4,471,795 | A | | 9/1984 | Linhardt |
| 4,477,223 | A | | 10/1984 | Giroux |
| 4,502,839 | A | | 3/1985 | Maddox |
| 4,511,309 | A | | 4/1985 | Maddox |
| 4,531,888 | A | | 7/1985 | Buchelt |
| 4,536,134 | A | | 8/1985 | Huiber |
| 4,541,531 | A | | 9/1985 | Brule |
| 4,541,607 | A | | 9/1985 | Hotger |
| 4,573,527 | A | | 3/1986 | McDonough |
| 4,574,815 | A | | 3/1986 | West |
| 4,648,806 | A | | 3/1987 | Alexander |
| 4,650,578 | A | | 3/1987 | Cerdan |
| 4,687,017 | A | | 8/1987 | Danko |
| 4,721,561 | A | | 1/1988 | Oetiker |
| 4,737,081 | A | | 4/1988 | Nakajima |
| 4,752,185 | A | | 6/1988 | Butler |
| 4,807,664 | A | | 2/1989 | Wilson |
| 4,813,495 | A | | 3/1989 | Leach |
| 4,821,737 | A | | 4/1989 | Nelson |
| 4,826,403 | A | | 5/1989 | Catlow |
| 4,830,331 | A | | 5/1989 | Vindum |
| 4,832,709 | A | | 5/1989 | Nagyszalanczy |
| 4,904,284 | A | | 2/1990 | Hanabusa |
| 4,984,830 | A | | 1/1991 | Saunders |
| 5,007,328 | A | | 4/1991 | Otterman |
| 5,024,585 | A | | 6/1991 | Kralovec |
| 5,043,617 | A | | 8/1991 | Rostron |
| 5,044,701 | A | | 9/1991 | Watanabe et al. |
| 5,045,046 | A | | 9/1991 | Bond |
| 5,054,995 | A | | 10/1991 | Kaseley |
| 5,064,452 | A | | 11/1991 | Yano et al. |
| 5,080,137 | A | | 1/1992 | Adams |
| 5,163,895 | A | | 11/1992 | Titus |
| 5,190,440 | A | | 3/1993 | Maier |
| 5,202,024 | A | | 4/1993 | Andersson |
| 5,202,026 | A | | 4/1993 | Lema |
| 5,203,891 | A | | 4/1993 | Lema |
| 5,207,810 | A | | 5/1993 | Sheth |
| 5,211,427 | A | | 5/1993 | Washizu |
| 5,244,479 | A | | 9/1993 | Dean, II |
| 5,246,346 | A | | 9/1993 | Schiesser |
| 5,280,766 | A | | 1/1994 | Mohn |
| 5,285,123 | A | | 2/1994 | Kataoka |
| 5,306,051 | A | | 4/1994 | Loker |
| 5,337,779 | A | | 8/1994 | Fukuhara |
| 5,378,121 | A | | 1/1995 | Hackett |
| 5,382,141 | A | | 1/1995 | Stinessen |
| 5,385,446 | A | | 1/1995 | Hays |
| 5,412,977 | A | | 5/1995 | Schmohl |
| 5,421,708 | A | | 6/1995 | Utter |
| 5,443,581 | A | | 8/1995 | Malone |
| 5,464,536 | A | | 11/1995 | Rogers |
| 5,484,521 | A | | 1/1996 | Kramer |
| 5,496,394 | A | | 3/1996 | Nied |
| 5,500,039 | A | | 3/1996 | Mori |
| 5,525,034 | A | | 6/1996 | Hays |
| 5,525,146 | A | | 6/1996 | Straub |
| 5,531,811 | A | | 7/1996 | Kloberdanz |
| 5,538,259 | A | | 7/1996 | Uhmer |
| 5,542,831 | A | | 8/1996 | Scarfone |
| 5,575,309 | A | | 11/1996 | Connell |
| 5,575,615 | A | | 11/1996 | Mohn |

(56) References Cited

U.S. PATENT DOCUMENTS 5,585,000 A 12/1996 Sassi
5,605,172 A 2/1997 Schubert
5,622,621 A 4/1997 Kramer
5,628,623 A 5/1997 Skaggs
5,634,492 A 6/1997 Steinruck et al.
5,640,472 A 6/1997 Meinzer et al.
5,641,280 A 6/1997 Timuska
5,653,347 A 8/1997 Larsson
5,664,420 A 9/1997 Hays
5,682,759 A 11/1997 Hays
5,683,235 A 11/1997 Welch
5,685,691 A 11/1997 Hays
5,687,249 A 11/1997 Kato
5,693,125 A 12/1997 Dean
5,703,424 A 12/1997 Dorman
5,709,528 A 1/1998 Hablanian
5,713,720 A 2/1998 Barhoum
5,720,799 A 2/1998 Hays
5,749,391 A 5/1998 Loutzenhiser
5,750,040 A 5/1998 Hays
5,775,882 A 7/1998 Kiyokawa et al.
5,779,619 A 7/1998 Borgstrom et al.
5,795,135 A 8/1998 Nyilas
5,800,092 A 9/1998 Nill
5,848,616 A 12/1998 Vogel
5,850,857 A 12/1998 Simpson
5,853,585 A 12/1998 Nesseth
5,861,052 A 1/1999 Meinander
5,863,023 A 1/1999 Evans
5,899,435 A 5/1999 Mitsch
5,935,053 A 8/1999 Strid
5,938,803 A 8/1999 Dries
5,938,819 A 8/1999 Seery
5,946,915 A 9/1999 Hays
5,951,066 A 9/1999 Lane
5,965,022 A 10/1999 Gould
5,967,746 A 10/1999 Hagi
5,971,702 A 10/1999 Afton
5,971,907 A 10/1999 Johannemann
5,980,218 A 11/1999 Takahashi
5,988,524 A 11/1999 Odajima
6,027,311 A 2/2000 Hill
6,035,934 A 3/2000 Stevenson
6,059,539 A 5/2000 Nyilas
6,068,447 A 5/2000 Foege
6,090,174 A 7/2000 Douma
6,090,299 A 7/2000 Hays
6,113,675 A 9/2000 Branstetter
6,122,915 A 9/2000 Hays
6,123,363 A 9/2000 Burgard
6,145,844 A 11/2000 Waggott
6,149,825 A 11/2000 Gargas
6,151,881 A 11/2000 Ai
6,187,208 B1 2/2001 White
6,196,962 B1 3/2001 Purvey
6,206,202 B1 3/2001 Galk
6,214,075 B1 4/2001 Filges
6,217,637 B1 4/2001 Toney
6,227,379 B1 5/2001 Nesseth
6,277,278 B1 8/2001 Conrad
6,312,021 B1 11/2001 Thomas
6,314,738 B1 11/2001 Hays
6,372,006 B1 4/2002 Pregenzer
6,375,437 B1 4/2002 Nolan
6,383,262 B1 5/2002 Marthinsen
6,394,764 B1 5/2002 Samurin
6,398,973 B1 6/2002 Saunders
6,402,465 B1 6/2002 Maier
6,426,010 B1 7/2002 Lecoffre
6,464,469 B1 10/2002 Grob
6,467,988 B1 10/2002 Czachor
6,468,426 B1 10/2002 Klass
6,485,536 B1 11/2002 Masters
6,530,484 B1 3/2003 Bosman
6,530,979 B2 3/2003 Firey
6,531,066 B1 3/2003 Sauders
6,537,035 B2 3/2003 Shumway
6,540,917 B1 4/2003 Rachels et al.
6,547,037 B2 4/2003 Kuzdzal
6,592,654 B2 7/2003 Brown
6,596,046 B2 7/2003 Conrad
6,599,086 B2 7/2003 Soja
6,607,348 B2 8/2003 Jean
6,616,719 B1 9/2003 Sun
6,617,731 B1 9/2003 Goodnick
6,629,825 B2 10/2003 Stickland
6,631,617 B1 10/2003 Dreiman
6,658,986 B2 12/2003 Pitla
6,659,143 B1 12/2003 Taylor
6,669,845 B2 12/2003 Klass
6,688,802 B2 2/2004 Ross
6,707,200 B2 3/2004 Carroll
6,718,955 B1 4/2004 Knight
6,719,830 B2 4/2004 Illingworth
6,764,284 B2 7/2004 Oehman
6,776,812 B2 8/2004 Komura
6,802,693 B2 10/2004 Reinfeld
6,802,881 B2 10/2004 Illingworth
6,811,713 B2 11/2004 Arnaud
6,817,846 B2 11/2004 Bennitt
6,827,974 B2 12/2004 Nelson
6,837,913 B2 1/2005 Schilling
6,843,836 B2 1/2005 Kitchener
6,878,187 B1 4/2005 Hays
6,893,208 B2 5/2005 Frosini
6,907,933 B2 6/2005 Choi
6,979,358 B2 12/2005 Ekker
7,000,893 B2 2/2006 Yakushi
7,001,448 B1 2/2006 West
7,013,978 B2 3/2006 Appleford
7,022,150 B2 4/2006 Borgstrom
7,022,153 B2 4/2006 McKenzie
7,025,890 B2 4/2006 Moya
7,033,410 B2 4/2006 Hilpert
7,033,411 B2 4/2006 Carlsson
7,056,363 B2 6/2006 Carlsson
7,063,465 B1 6/2006 Wilkes
7,112,036 B2 9/2006 Lubell
7,131,292 B2 11/2006 Ikegami
7,144,226 B2 12/2006 Pugnet
7,159,723 B2 1/2007 Hilpert
7,160,518 B2 1/2007 Chen
7,169,305 B2 1/2007 Gomez
7,185,447 B2 3/2007 Arbeiter
7,204,241 B2 4/2007 Thompson
7,241,392 B2 7/2007 Maier
7,244,111 B2 7/2007 Suter
7,258,713 B2 8/2007 Eubank
7,270,145 B2 9/2007 Koezler
7,288,139 B1 10/2007 Showalter
7,288,202 B2 10/2007 Maier
7,314,560 B2 1/2008 Yoshida
7,323,023 B2 1/2008 Michele
7,328,749 B2 2/2008 Reitz
7,335,313 B2 2/2008 Moya
7,377,110 B2 5/2008 Sheridan
7,381,235 B2 6/2008 Koene
7,396,373 B2 7/2008 Lagerstedt
7,399,412 B2 7/2008 Keuschnigg
7,435,290 B2 10/2008 Lane
7,445,653 B2 11/2008 Trautmann
7,470,299 B2 12/2008 Han
7,473,083 B2 1/2009 Oh
7,479,171 B2 1/2009 Cho
7,494,523 B2 2/2009 Oh
7,501,002 B2 3/2009 Han
7,520,210 B2 4/2009 Theodore, Jr.
7,575,422 B2 8/2009 Bode
7,578,863 B2 8/2009 Becker
7,591,882 B2 9/2009 Harazim
7,594,941 B2 9/2009 Zheng
7,594,942 B2 9/2009 Polderman
7,610,955 B2 11/2009 Irwin
7,628,836 B2 12/2009 Baronet

(56) References Cited

U.S. PATENT DOCUMENTS

| | | | |
|---|---|---|---|
| 7,637,699 | B2 | 12/2009 | Albrecht |
| 7,674,377 | B2 | 3/2010 | Carew |
| 7,677,308 | B2 | 3/2010 | Kolle |
| 7,708,537 | B2 | 5/2010 | Bhatia |
| 7,708,808 | B1 | 5/2010 | Heumann |
| 7,744,663 | B2 | 6/2010 | Wallace |
| 7,748,079 | B2 | 7/2010 | McDowell |
| 7,766,989 | B2 | 8/2010 | Lane |
| 7,811,344 | B1 | 10/2010 | Duke |
| 7,811,347 | B2 | 10/2010 | Carlsson |
| 7,815,415 | B2 | 10/2010 | Kanezawa |
| 7,824,458 | B2 | 11/2010 | Borgstrom |
| 7,824,459 | B2 | 11/2010 | Borgstrom |
| 7,846,228 | B1 | 12/2010 | Saaaki |
| 7,938,874 | B2 | 5/2011 | Auber |
| 2001/0007283 | A1 | 7/2001 | Johal |
| 2002/0009361 | A1 | 1/2002 | Reichert |
| 2003/0029318 | A1 | 2/2003 | Firey |
| 2003/0035718 | A1 | 2/2003 | Langston |
| 2003/0136094 | A1 | 7/2003 | Illingworth |
| 2003/0192718 | A1 | 10/2003 | Buckman |
| 2004/0007261 | A1 | 1/2004 | Cornwell |
| 2004/0170505 | A1 | 9/2004 | Lenderink |
| 2005/0173337 | A1 | 8/2005 | Costinel |
| 2005/0241178 | A1 | 11/2005 | Arbeiter |
| 2006/0065609 | A1 | 3/2006 | Arthur |
| 2006/0090430 | A1 | 5/2006 | Trautman |
| 2006/0096933 | A1 | 5/2006 | Maier |
| 2006/0157251 | A1 | 7/2006 | Stinessen |
| 2006/0157406 | A1 | 7/2006 | Maier |
| 2006/0193728 | A1 | 8/2006 | Lindsey |
| 2006/0222515 | A1 | 10/2006 | Delmotte |
| 2006/0230933 | A1 | 10/2006 | Harazim |
| 2006/0239831 | A1 | 10/2006 | Garris, Jr. |
| 2006/0254659 | A1 | 11/2006 | Ballot |
| 2006/0275160 | A1 | 12/2006 | Leu |
| 2007/0029091 | A1 | 2/2007 | Stinessen |
| 2007/0036646 | A1 | 2/2007 | Nguyen |
| 2007/0051245 | A1 | 3/2007 | Yun |
| 2007/0062374 | A1 | 3/2007 | Kolle |
| 2007/0065317 | A1 | 3/2007 | Stock |
| 2007/0084340 | A1 | 4/2007 | Dou |
| 2007/0140815 | A1 | 6/2007 | Shinozaki |
| 2007/0140870 | A1 | 6/2007 | Fukanuma |
| 2007/0151922 | A1 | 7/2007 | Mian |
| 2007/0163215 | A1 | 7/2007 | Lagerstadt |
| 2007/0172363 | A1 | 7/2007 | Laboube |
| 2007/0196215 | A1 | 8/2007 | Frosini |
| 2007/0227969 | A1 | 10/2007 | Dehaene |
| 2007/0256398 | A1 | 11/2007 | Barone |
| 2007/0294986 | A1 | 12/2007 | Beetz |
| 2008/0031732 | A1 | 2/2008 | Peer |
| 2008/0039732 | A9 | 2/2008 | Bowman |
| 2008/0179261 | A1 | 7/2008 | Patrovsky |
| 2008/0246281 | A1 | 10/2008 | Agrawal |
| 2008/0315812 | A1 | 12/2008 | Balboul |
| 2009/0013658 | A1 | 1/2009 | Borgstrom |
| 2009/0015012 | A1 | 1/2009 | Metzler |
| 2009/0025562 | A1 | 1/2009 | Hallgren |
| 2009/0025563 | A1 | 1/2009 | Borgstrom |
| 2009/0151928 | A1 | 6/2009 | Lawson |
| 2009/0169407 | A1 | 7/2009 | Yun |
| 2009/0173095 | A1 | 7/2009 | Bhatia |
| 2009/0266231 | A1 | 10/2009 | Franzen |
| 2009/0304496 | A1 | 12/2009 | Maier |
| 2009/0321343 | A1 | 12/2009 | Maier |
| 2009/0324391 | A1 | 12/2009 | Maier |
| 2010/0007133 | A1 | 1/2010 | Maier |
| 2010/0021292 | A1 | 1/2010 | Maier |
| 2010/0038309 | A1 | 2/2010 | Maier |
| 2010/0043288 | A1 | 2/2010 | Wallace |
| 2010/0043364 | A1 | 2/2010 | Curien |
| 2010/0044966 | A1 | 2/2010 | Majot |
| 2010/0072121 | A1 | 3/2010 | Maier |
| 2010/0074768 | A1 | 3/2010 | Maier |
| 2010/0083690 | A1 | 4/2010 | Sato |
| 2010/0090087 | A1 | 4/2010 | Maier |
| 2010/0139776 | A1 | 6/2010 | Auber |
| 2010/0143172 | A1 | 6/2010 | Sato |
| 2010/0163232 | A1 | 7/2010 | Kolle |
| 2010/0183438 | A1 | 7/2010 | Maier |
| 2010/0239419 | A1 | 9/2010 | Maier |
| 2010/0239437 | A1 | 9/2010 | Maier |
| 2010/0247299 | A1 | 9/2010 | Maier |
| 2010/0257827 | A1 | 10/2010 | Lane |
| 2011/0017307 | A1 | 1/2011 | Kidd |
| 2011/0061536 | A1 | 3/2011 | Maier |

FOREIGN PATENT DOCUMENTS

| | | | |
|---|---|---|---|
| CA | 2578262 | | 9/2005 |
| CA | 2647511 | | 10/2007 |
| DE | 1024439 | B | 2/1958 |
| EP | 0150599 | | 8/1985 |
| EP | 301285 | | 10/1991 |
| EP | 561065 | | 11/1991 |
| EP | 552837 | | 1/1993 |
| EP | 1582703 | | 10/2005 |
| EP | 2013479 | | 1/2009 |
| EP | 2063975 | | 6/2009 |
| EP | 2233745 | | 9/2010 |
| EP | 2322282 | | 5/2011 |
| EP | 1796808 | | 7/2011 |
| GB | 417373 | | 10/1934 |
| GB | 1192354 | | 5/1970 |
| GB | 1512381 | | 6/1978 |
| GB | 2323639 | | 9/1998 |
| GB | 2337561 | | 11/1999 |
| GB | 2477699 | | 8/2011 |
| JP | 54099206 | | 1/1978 |
| JP | 80 68501 | | 3/1996 |
| JP | 8-284961 | A | 11/1996 |
| JP | 2002 242699 | | 8/2002 |
| JP | 3711028 | | 10/2005 |
| JP | 2005291202 | | 10/2005 |
| KR | 2009085521 | | 2/2008 |
| MX | 2008012579 | | 12/2008 |
| WO | WO9524563 | | 9/1995 |
| WO | WO9619276 | | 6/1996 |
| WO | WO0074811 | | 12/2000 |
| WO | WO0117096 | | 3/2001 |
| WO | WO2005003512 | | 1/2005 |
| WO | WO2006029413 | | 3/2006 |
| WO | WO2006053088 | | 5/2006 |
| WO | WO2007043889 | | 4/2007 |
| WO | WO2007103248 | | 9/2007 |
| WO | WO2007120506 | | 10/2007 |
| WO | WO2008036221 | | 3/2008 |
| WO | WO2008039446 | | 3/2008 |
| WO | WO2008039491 | | 4/2008 |
| WO | WO2008039731 | | 4/2008 |
| WO | WO2008039732 | | 4/2008 |
| WO | WO2008039733 | | 4/2008 |
| WO | WO2008039734 | | 4/2008 |
| WO | WO2008036394 | | 7/2008 |
| WO | WO2009111616 | | 9/2009 |
| WO | WO2009158252 | | 12/2009 |
| WO | WO2009158253 | | 12/2009 |
| WO | WO2010065303 | | 6/2010 |
| WO | WO2010083416 | | 7/2010 |
| WO | WO2010083427 | | 7/2010 |
| WO | WO2010107579 | | 9/2010 |
| WO | WO2010110992 | | 9/2010 |
| WO | WO2011034764 | | 3/2011 |
| WO | WO2011100158 | | 8/2011 |
| WO | WO2012009158 | | 1/2012 |
| WO | WO2012009159 | | 1/2012 |
| WO | WO2012012143 | | 1/2012 |
| WO | WO2012033632 | | 3/2012 |

OTHER PUBLICATIONS

Tri-Phase Rotary Separator Turbine, Multiphase Power & Processing Technologies LLC Technical Literature (available at http://www/mpptech.com/techpp/pdfs/Tri-Phase.pdf).

(56) References Cited

OTHER PUBLICATIONS

IRIS™ In-Line Rotary Separator/Scrubber, Multiphase Power & Processing Technologies LLC Technical Literature (available at http://www.mpptech.com/products/IRIS_Rev5.2PDF).
Testing of an In-Line Rotary Separator (IRIS™) at the Chevron F. Ramirez Gas Production Facility by Hank Rawlins and Frank Ting, Presented at 52nd Annual Laurence Reid Gas Conditioning Conference, The University of Oklahoma, Feb. 24-27, 2002.
Utilization of Inline Rotary Separator as a Wet Gas Meter by V.C. Ting Presented at the 19th North Sea Flow Measurement Workshop 2001.
Analysis of Results of a Rotary Separator Rubine on the Shell Ram-Powell TLP by Greg Ross, Keith Oxley and Hank Rowlins.
Field Test Results of a Rotary Separator Turbine on the Ram/Powell TLP by C.H. Rawlins and G.D. Ross, presented at the 2001 Offshore Technology Conference in Houston, Texas Apr. 30-May 3, 2001.
Two-Phase Flow Turbine in Oil and Gas Production and Processing by Geirmund Vislie and Simon RH Davies.
Further Developments of the Biphase Rotary Separator Turbine by Geirmund Vislie, Simon Davis and Lance Hays.
"Technical Manual—High Pessure Air Compressor Model 13NL45", NAVSEA S6220-AT-MMA-010/93236, Oct. 28, 1991, pp. 3-23 to 3-32, Electric Boat Corporation, Groton, CT 06340.
EP05796401—Supplementary European Search Report mailed Aug. 26, 2008.
EP10196474—European Search Report mailed Mar. 21, 2011.
PCT/GB95/00193 Notification of international Search Report mailed Jun. 2, 1995.
PCT/FI00/00496—International Search Report mailed Oct. 16, 2000.
PCT/US2005/032556—Notification of international Preliminary Report on Patentability mailed Mar. 13, 2007.
PCT/US2005/032556—Notification of International Search Report and Written Opinion mailed Oct. 18, 2006.
PCT/U52005/040664—Notification of International Search Report and Written Opinion mailed Oct. 17, 2006.
PCT/NO2006/000341—International Search Report mailed Jan. 11, 2007.
PCT/US2007/008149—International Preliminary Report on Patentability dated Sep. 30, 2008.
PCT/US2007/008149—Written Opinion dated Jul. 17, 2008.
PCT/US2007/020101—International Preliminary Report on Patentability dated Apr. 2, 2009.
PCT/US2007/020101—International Search Report dated Apr. 29, 2008.
PCT/US2007/020471—International Preliminary Report on Patentability dated Apr. 2, 2009.
PCT/US2007/020471—International Search Report and Written Opinion dated Apr. 1, 2008.
PCT/U52007/020659—International Preliminary Report on Patentability dated Mar. 31, 2009.
PCT/US2007/020659—International Search Report and Written Opinion dated Sep. 17, 2008.
PCT/US2007/020768—International Preliminary Report on Patentability dated Apr. 9, 2009.
PCT/US2007/020768—International Search Report and Written Opinion dated Mar. 3, 2008.
PCT/US2007/079348—International Preliminary Report on Patentability dated Apr. 9, 2009.
PCT/US2007/079348—International Search Report dated Apr. 11, 2008.
PCT/US2007/079348—Written Opinion mailed Apr. 11, 2008.
PCT/US2007/079349—International Preliminary Report on Patentability dated Mar. 31, 2009.
PCT/US2007/079349—International Search Report and Written Opinion dated Apr. 2, 2008.
PCT/US2007/079350—International Preliminary Report on Patentability mailed Apr. 9, 2009.
PCT/US2007/079350—International Search Report mailed Apr. 2, 2008.
PCT/US2007/079350—Written Opinion mailed Apr. 2, 2008.
PCT/US2007/079352—International Preliminary Report on Patentability dated Apr. 9, 2009.
PCT/US2007/079352—International Search Report and Written Opinion dated Aug. 27, 2008.
PCT/US2009/036142—International Preliminary Report on Patentability dated Sep. 16, 2010.
PCT/US2009/036142—International Search Report mailed May 11, 2009.
PCT/US2009/036142—Written Opinion dated May 11, 2009.
PCT/US2009/047662—International Preliminary Report on Patentability dated Jan. 13, 2011.
PCT/US2009/047662—Written Opinion dated Aug. 20, 2009.
PCT/US2009/064916—Notification of International Preliminary Report on Patentability mailed Jun. 15, 2011.
PCT/US2009/064916—Notification of International Search Report and Written Opinion mailed Jan. 25, 2010.
PCT/US2010/021199—International Preliminary Report on Patentability dated Mar. 29, 2011.
PCT/US2010/021199—International Search Report and Written Opinion dated Mar. 22, 2010.
PCT/US2010/021218—International Report on Patentability dated Feb. 2, 2011.
PCT/US2010/021218—International Search Report and Written Opinion dated Mar. 23, 2010.
PCT/US2010/025650—International Report on Patentability dated Mar. 14, 2011.
PCT/US2010/025650—International Search Report and Written Opinion dated Apr. 22, 2010.
PCT/US2010/025952—International Report on Patentability dated Mar. 14, 2011.
PCT/US2010/025952—International Search Report and Written Opinion dated Apr. 12, 2010.
PCT/US2011/023593—Notification of International Search Report and Written Opinion dated Oct. 18, 2011.
PCT/US2011/037112—Notification of International Search Report and Written Opinion mailed Jan. 13, 2012.
PCT/US2011/042205—Notification of International Search Report and Written Opinion mailed Feb. 21, 2012.
PCT/US2011/042209—International Search Report mailed Feb. 24, 2012.
PCT/US2011/042227—Notification of International Search Report dated Feb. 21, 2012.
PCT/US2011/048652—Notification of International Search Report and Written Opinion mailed Jan. 9, 2012.

* cited by examiner

FLUSH-ENABLED CONTROLLED FLOW DRAIN

This application claims priority to U.S. Provisional Patent Application having Ser. No. 61/381,423, filed Sep. 9, 2010. This priority application is incorporated herein in its entirety, to the extent consistent with the present application.

This application is a United States national stage application of PCT Patent Application No. US2011/048652, filed Aug. 22, 2011, which claims priority to U.S. Provisional application No. 61/381,423, filed Sep. 9, 2010. The contents of each priority application are incorporated herein by reference to the extent consistent with the disclosure.

Motor-compressors are often used in subsea environments to support hydrocarbon recovery applications. Given the high cost of intervention, subsea motor-compressors are generally required to be robust, reliable machines that remain efficient over long periods of uninterrupted service. Operating a motor-compressor in subsea environments, however, can be challenging for a variety of reasons. For example, subsea machines are typically required to survive without maintenance intervention in an environment that promotes severe plugging or fouling and the incidental buildup of liquids in the cavities where the motor and bearing systems are disposed. To avoid damaging the motor and bearing systems, or interrupting hydrocarbon production, this liquid has to be periodically, if not continuously, drained from these liquid-sensitive cavities.

Draining the liquid, however, promotes fouling of drain orifices and can lead to the buildup of debris which can eventually clog essential drainage ports. Moreover, draining liquid buildup is often accompanied by a loss of gas, commonly referred to as "gas carry-under," such as cooling fluids or working fluid. The amount of gas carry-under leaking through the drainage system has a direct impact on the amount of power used by the compressor, and therefore on the overall efficiency of the compression system.

In at least one prior drainage system, actively controlled traps or other gas-break systems are employed to allow liquids to be drained while preventing any gas to be leaked through the drainage system. Nonetheless, active trap systems that are suitable for subsea applications are very costly and complex, or otherwise unreliable due to a significant part count.

Other control flow drainage systems employ passive, limited-flow drain devices. Such devices use a type of flow restrictor or throttle configured to limit undesirable gas egress while allowing all liquids to drain out of the cavities to an appropriate liquid tolerant portion of the system. For these types of systems, however, a minimum flow restrictor size is required, especially where plugging or fouling of the flow restrictor is a concern.

Another type of control flow drainage system uses a vortex throttle having a purely tangential nozzle configured to impart circumferential velocity to the flow. A drain passage is typically disposed close to the centerline of the vortex throttle, at the bottom of a circular swirl chamber. These devices enjoy a low flow coefficient due to the dissipation of energy in the vortex flow set up in the swirl chamber. Although vortex throttles relax the sensitivity of a passively controlled drain by providing a lower flow coefficient, the flow limiting passages are still subject to fouling or plugging in severe service. In addition, the typical tangential inlet topology of the vortex throttle is not amenable to robust, compact construction for high-pressure subsea applications.

What is needed, therefore, is a controlled flow drainage system that overcomes these and other limitations of prior control flow drains.

SUMMARY

Embodiments of the disclosure may provide a controlled flow drain. The drain may include an upper flange coupled to a lower flange, the upper flange defining an inlet fluidly coupled to an upper drain pipe, and the lower flange defining an exit fluidly coupled to a lower drain pipe. The drain may further include a director orifice fluidly coupled to the inlet of the upper flange and in fluid communication with an inlet cavity defined within the upper flange, and a swirl nozzle plate disposed within the upper flange and configured to receive a drain flow via the inlet and director orifice and accommodate accumulation of debris thereon. The drain may also include a debris fence coupled to the swirl nozzle plate within the upper flange, a swirl nozzle defined within the swirl nozzle plate and at least partially surrounded by the debris fence, the swirl nozzle providing fluid communication between the inlet cavity and a swirl chamber, and an annular groove fluidly communicable with the swirl chamber and defined within the lower flange, the annular groove having a series of flushing liquid injection ports symmetrically-arrayed thereabout. The drain may also include an exit control passage defined within the drain restrictor and in fluid communication with the exit and the lower drain pipe.

Embodiments of the disclosure may further provide a method of controlling a drain flow. The method may include receiving the drain flow into an upper flange coupled to a lower flange, the upper flange defining an inlet and the lower flange defining an exit, centralizing the drain flow into an inlet cavity defined within the upper flange, and segregating debris within the drain flow from a swirl nozzle defined within a swirl nozzle plate, the swirl nozzle providing fluid communication between the inlet cavity and a swirl chamber defined in the lower flange. The method may further include accelerating the drain flow through the swirl nozzle to generate a vortical fluid flow that forces dense debris within the drain flow to a radially outer extent of the swirl chamber, and accumulating the dense debris within an annular groove fluidly coupled to the swirl chamber and defined within the lower flange. The drain flow may then be drained from the lower flange via an exit control passage.

Embodiments of the disclosure may further provide another controlled flow drain. The drain may include an upper flange coupled to a lower flange, the upper flange defining an inlet fluidly coupled to an upper drain pipe, and the lower flange defining an exit fluidly coupled to a lower drain pipe. The drain may further include an inlet cavity fluidly coupled to the inlet, a swirl chamber fluidly coupled to the exit, and a swirl nozzle plate disposed between the inlet cavity and the swirl chamber and having a debris fence coupled thereto, the debris fence being disposed within the inlet cavity. The drain may also include a swirl nozzle defined within the swirl nozzle plate and providing fluid communication between the inlet cavity and the swirl chamber, and an annular groove defined within the lower flange and in fluid communication with the swirl chamber, the annular groove having a curved radius defined about its upper periphery where the annular groove meets the swirl chamber. The drain may also include an exit control passage defined within lower flange and in fluid communication with the exit and the lower drain pipe.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
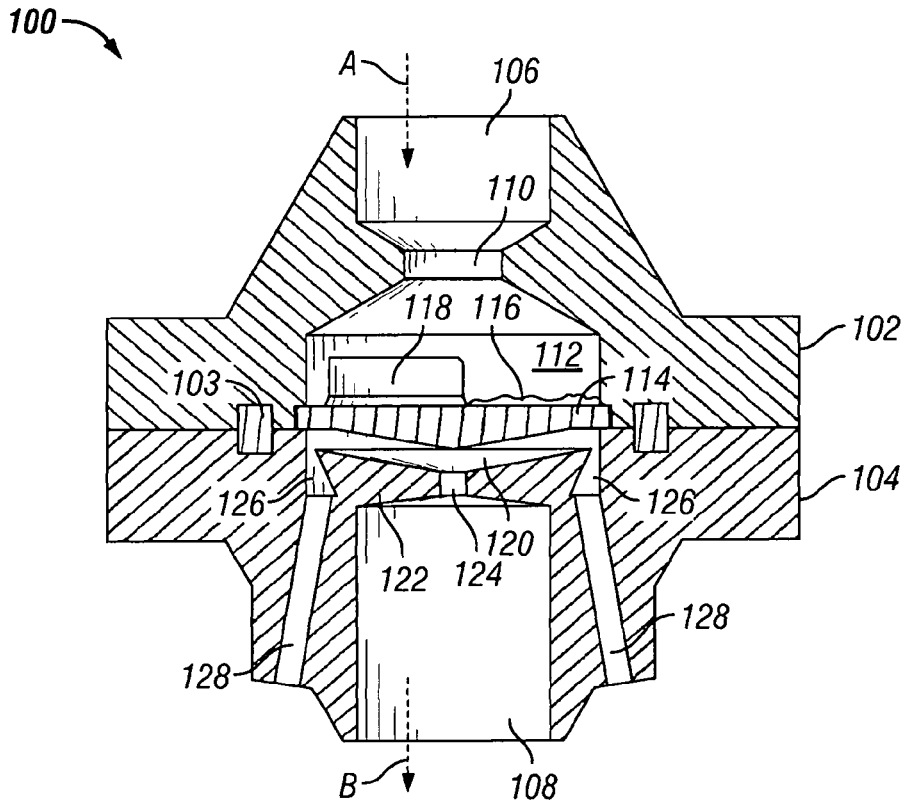
FIG. 1 illustrates a cross-sectional view of an exemplary drain, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a cross-sectional view of an exemplary controlled flow drain 100, according to one or more embodiments disclosed herein. The drain 100 may be used to remove unwanted fluids and/or contaminants away from one or more contamination-sensitive cavities within a turbomachine (not shown), such as a motor-compressor. The drain 100 may be configured to simultaneously limit or otherwise preclude undesirable exiting of gas from the contamination-sensitive cavities. In at least one embodiment, the drain 100 may be employed in conjunction with a subsea motor-compressor configured to receive and compress a working fluid, such as a hydrocarbon gas, including but not limited to natural gas or methane.

The drain 100 may be embedded or otherwise defined within a modified high-pressure pipe flange, including an upper flange 102 and a lower flange 104. In at least one embodiment, the upper and lower flanges 102, 104 may form a single-piece pipe flange. In the depicted embodiment, however, the upper and lower flanges 102, 104 may be coupled together as known by those skilled in the art, such as by mechanical fasteners (i.e., bolts), welding, brazing, or combinations thereof. An annular seal 103 may be disposed between the flanges 102, 104 and configured to sealingly engage the flanges 102, 104, thereby creating a fluid-tight seal therebetween. In one embodiment, the annular seal 103 may be an O-ring, but may also include other types of seals without departing from the scope of the disclosure.

The upper and lower flanges 102, 104 may be coupled to upper and lower drain pipes (not shown), respectively, of the accompanying turbomachine in order to channel and remove the unwanted fluids and/or contaminants from the liquid-sensitive cavities within the turbomachine. The unwanted fluids and/or contaminants may include liquids, such as water or hydrocarbon-based liquids, but may also include gases derived from the interior of the contamination-sensitive cavities described above.

To minimize plugging, the connecting upper and lower drain pipes may provide at least four times the flow area of the drain 100. In at least one embodiment, the connecting upper and lower drain pipes provide ten or more times the flow area of the drain 100. As depicted, the drain 100 may be oriented with respect to gravity having an inlet 106 at its upper extent defined within the upper flange 102, and an exit 108 at its bottom extent defined within the lower flange 104. Accordingly, drain fluid flow proceeds in a generally axial direction with respect to the drain's axis of symmetry Q, and as depicted by arrows A and B.

As the drain flow enters the inlet 106, it is directed through a director orifice 110 configured to centralize the incoming drain flow and direct it into an inlet cavity 112 and subsequently to the center of a succeeding swirl nozzle plate 114. The inlet cavity 112 may be an axisymmetric, profiled cavity formed within the upper flange 102 and partially defined at its base by the upper surface of the swirl nozzle plate 114. As the inlet cavity 112 receives the drain flow, particulate contamination or debris 116 contained within the drain flow is deposited or otherwise collected on the upper surface of the swirl nozzle plate 114. Typical debris 116 can include metallic pieces, rust, rock, sand, corrosion particles, sediment deposits, and/or combinations thereof.

A debris fence 118 is disposed within the inlet cavity 112 and may be welded to or otherwise milled into the swirl nozzle plate 114. As shown and described below with reference to FIGS. 2A and 2B, the debris fence 118 may surround a nozzle inlet 204 of a swirl nozzle 202. In operation, the debris fence 118 is at least partially configured to segregate the swirl nozzle 202 inlet area 204 from the debris 116 accumulating on the upper surface of the swirl nozzle plate 114. At the same time, the debris fence 118 allows drainage fluids to flow over the top of the debris fence 118 and into the swirl nozzle 202. Accordingly, the swirl nozzle 202 may provide fluid communication between the inlet cavity 112 and a swirl chamber 120, as will be described below.

Figure 2A:
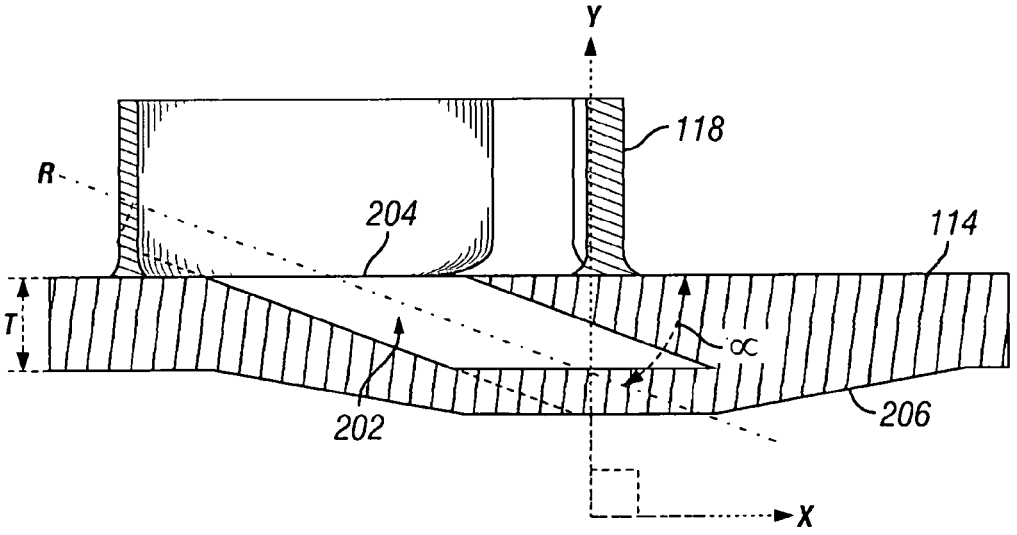
FIG. 2A illustrates a side view of a debris fence and swirl nozzle, according to one or more embodiments disclosed.
Figure 2B:
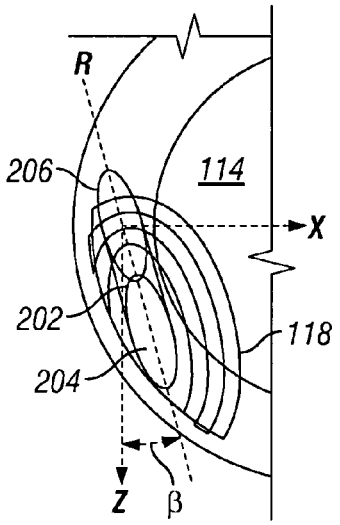
FIG. 2B illustrates a plan view of a debris fence and swirl nozzle, according to one or more embodiments disclosed.

Referring to FIGS. 2A and 2B, illustrated is the swirl nozzle 202 having a nozzle inlet 204 and a nozzle outlet 206. FIG. 2A depicts a side view of the swirl nozzle 202 and FIG. 2B depicts a plan view of the swirl nozzle 202. As illustrated, the swirl nozzle 202 may be defined or otherwise formed in the swirl nozzle plate 114, and the debris fence 118 may at least partially surround the nozzle inlet 204. The swirl nozzle 202 may include a prismatic cylindrical passage having a central axis R.

In one or more embodiments, the swirl nozzle 202 may be defined or otherwise arranged using compound declination angles. For example, as shown in FIG. 2A, the central axis R of the swirl nozzle 202 may be arranged at an angle $\alpha$ with respect to the horizontal X axis, thereby imparting a downward pitch to the swirl nozzle 202 with respect to horizontal. In at least one embodiment, the angle $\alpha$ may be about 20° or less. Moreover, as shown in FIG. 2B, the swirl nozzle 202 may be further arranged at an angle $\beta$ with respect to the Z axis, thereby positioning the central axis R at an angle $\beta$ with respect to a tangential discharge pitch circle in the radial plane. In other words, disposing the central axis R at an angle $\beta$ effectively rotates the central axis R away from a purely tangential discharge position with respect to the sub-regions disposed below the swirl nozzle plate 114. In at least one embodiment, the angle $\beta$ may be about 15°. As will be appreciated, however, the angle $\beta$ may be adjusted in accordance with the desired diameter of the swirl nozzle 202. Accordingly, a broad range of diameters for the swirl nozzle 202 may be had simply by adjusting the angle $\beta$.

The use of double compound declination angles $\alpha$ and $\beta$ allow for a compact geometry with both the nozzle inlet 204 and outlet 206 of the swirl nozzle 202 being contained within the same concentric circular boundary. Such a design maintains over 90% of the theoretical tangential swirl velocity as compared to the bulkier prior art designs described above that use a purely tangential swirl nozzle design.

In one or more embodiments, the overall thickness T (FIG. 2A) of the swirl nozzle plate 114 allows for the fully-cylindrical portion of the swirl nozzle 202 between its nozzle inlet 204 and outlet 206 breakout regions to be approximately equal to the nozzle 202 passage diameter in length. When concern about gas carry-under is the controlling constraint, the size of the swirl nozzle 202 may be fixed at the minimum diameter deemed acceptable by those skilled in the art for proof against blockage by possible fouling particles and debris. In at least one embodiment, an industrially-acceptable size of the swirl nozzle 202 may range from about ⅛ inch to about ¼ inch in diameter.

Referring again to FIG. 1, the drain 100 may further include a swirl chamber 120 formed or otherwise defined within the lower flange 104, the swirl chamber having its upper extent defined by the frustoconical, lower surface of the swirl nozzle plate 114 and its lower extent defined by a drain restrictor 122. The drain restrictor 122 may also have a generally frustoconical shape and include an exit control passage 124 centrally-defined therein. In at least one embodiment, the frustoconical, lower surface of the swirl nozzle plate 114 and the generally frustoconical shape of the drain restrictor 122 may be opposing parallel surfaces that are slightly angled to mirror each other. In one embodiment, the declination angle of the frustoconical, lower surface of the swirl nozzle plate 114 and the generally frustoconical shape of the drain restrictor 122 may be about 10°, but such angle may be modified to suit varying applications where fluids with differing flow coefficients are used. The frustoconical shape of the drain restrictor 122 may further generate a low point in the swirl chamber 120 where drain flow will accumulate and drain via the exit control passage 124. The frustoconical shape may also prevent incidental buildup of solids and/or liquids on the surface of the drain restrictor 122. This may be especially important for drainage when liquid is present with little or no pressure difference imposed across the drain restrictor 122.

The exit control passage 124 may be configured to minimize through-flow, and therefore act as a restrictor. In one embodiment, the exit control passage 124 includes sharp edges adapted to permit liquid drainage therethrough but concurrently control or otherwise restrict gas carry-under. The exit control passage 124 is in fluid communication with the downstream exit 108 discharge, which in turn fluidly communicates with the downstream exit piping system (not shown). In operation, the amount of flow through exit control passage 124 is generally controlled by the series combination of the pressure drops required to force the drain fluids through the swirl nozzle 202, the vortex flow generated by the swirl nozzle 202, and the general configuration of the exit control passage 124. In at least one embodiment, the diameter of the exit control passage 124 may be the same as the diameter of the swirl nozzle 202. As will be appreciated, however, the diameter of the exit control passage 124 may be greater than or less than the diameter of the swirl nozzle 202, without departing from the scope of the disclosure.

The swirl chamber 120 may be a generally cylindrical space configured to allow the drain flow exiting the swirl nozzle 202 (FIGS. 2A and 2B) to develop into a fully vortical fluid flow. Several novel features of the geometry of the swirl chamber 120 are directed at facilitating long service in difficult unattended subsea conditions. For example, in at least one embodiment, the geometry of the swirl chamber 120 includes a height roughly equal to the swirl nozzle 202 diameter. As can be appreciated, however, the height of the swirl chamber 120 may be modified to be greater or less than the swirl nozzle 202 diameter, without departing from the scope of the disclosure. In addition, to minimize the flow coefficient, the diameter of the swirl chamber 120 may be from about 5 to about 10 times the swirl nozzle 202 diameter.

Another significant feature of the swirl chamber 120 is the provision for the collection and removal of debris 116 from the swirl chamber 120 by flushing the debris 116 and any other fouling matter away from the swirl chamber 120. To accomplish this, the swirl chamber 120 may fluidly communicate with an annular groove 126 and a series of flushing liquid injection ports 128 (two shown in FIG. 1) symmetrically-arrayed about the annular groove 126. As illustrated, the annular groove 126 may be formed about the drain restrictor 122 on the lower surface and outer extent of the swirl chamber 120. The flushing liquid injection ports 128 may be configured to feed a flushing liquid from external piping connections (not shown) into the swirl chamber 120. In one embodiment, the flushing liquid may be water, but may also include liquids derived from hydrocarbons or other liquid sources known in the art. Until needed for flushing, the flushing liquid injection ports 128 are sealed and no fluid flow passes therethrough.

The vortical fluid flow exiting the swirl nozzle 202 into the swirl chamber 120 will force dense debris 116 disposed within the drain flow to the radially outer extent of the swirl chamber 120, where the debris 116 eventually settles into the annular groove 126 without obstructing the general area of swirl chamber 120 itself. At some point, during a duty cycle of the turbomachine, for example, the debris 116 accumulated within the annular groove 126 may be flushed out by injecting flushing liquid into the annular groove 126 via the flushing liquid injection ports 128. When flushing is carried out, the flushing liquid flows uniformly from these ports 128, pressurizes the swirl chamber 120, and thereby forces accumulated debris 116 out of the swirl chamber 120 and through the exit control passage 124. As can be appreciated, pressurizing the swirl chamber 202 may serve to fluidize at least a portion of the solid contaminants or debris settled in the annular ring 126. Once fluidized, the debris more easily exits the exit control passage 124.

The pressurized flushing liquid also serves to remove fouling that may have built up on the edges of the exit control passage 124. Moreover, because the swirl chamber 120 becomes pressurized, a fraction of the flushing liquid is simultaneously forced through the swirl nozzle 202 at a significant pressure. Consequently, flushing the swirl chamber 120 also dislodges debris 116 or fouling matter formed on the swirl nozzle 202, and such dislodged debris 116 and/or fouling matter can then be removed from the drain 100 via the exit control passage 124.

Figure 3:
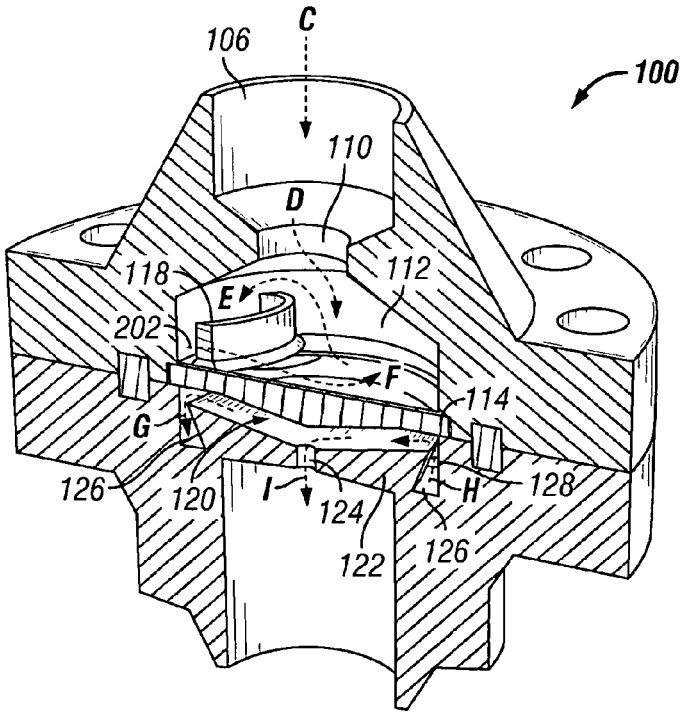
FIG. 3 illustrates a cross-sectional isometric view of the drain shown in FIG. 1.

Referring now to FIG. 3, illustrated is a cross-sectional isometric view of the drain 100 shown in FIG. 1. As such, FIG. 3 may be best understood with reference to FIG. 1, where like numerals correspond to like elements and therefore will not be described again in detail. In exemplary operation, drain fluid enters the drain 100 via the inlet 106, as shown by arrow C. The director orifice 110 centralizes the incoming drain flow and directs it into the inlet cavity 112 and the succeeding swirl nozzle plate 114, as shown by arrow D. While the more dense debris 116 (FIG. 1) and other contaminating materials accumulate on the upper surface of the swirl nozzle plate 114, the less dense fluid flows over the top of the debris fence 118 and toward the swirl nozzle 202, as shown by arrow E.

As the drain flow channels through the swirl nozzle 202, it is accelerated and develops into a fully vortical fluid flow within the swirl chamber 120, as shown by arrow F. The vortical fluid flow exiting the swirl nozzle 202 forces dense debris and other contaminants within the drain flow to the radially outer extent of the swirl chamber 120 where they eventually settle into the annular groove 126, as shown by arrow G. By injecting flushing fluid via the flushing liquid injection ports 128 (one shown in FIG. 3), the debris and contaminants are removed or otherwise flushed from the annular groove 126 and to the frustoconical surface of the drain restrictor 122, as shown by arrow H. Flushing the swirl chamber 120 also serves to pressurize the swirl chamber, thereby forcing drain flow and unwanted contaminants down the exit control passage 124, as shown by arrow I. In at least one embodiment, a valve (not shown) located upstream from the inlet 106 to the drain 100 may be closed during flushing operations, thereby promoting the full pressurization of the drain and the consequential removal of debris 116 (FIG. 1) via the exit control passage 124.

Figure 4:
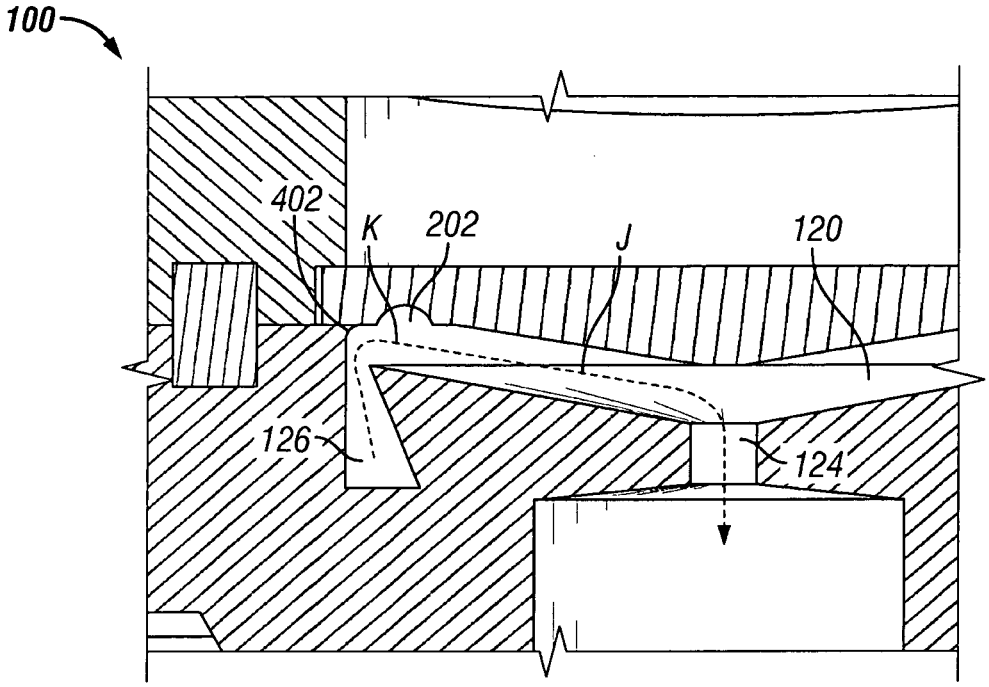
FIG. 4 illustrates a close-up cross-sectional view of a portion of the drain shown in FIG. 1, according to one or more embodiments of the disclosure.

Referring now to FIG. 4, illustrated is a partial cross-sectional view of the drain 100, and in particular a sectional view of the swirl chamber 120 and its interaction or fluid communication with the annular groove 126. In at least one embodiment, the upper periphery of the annular groove 126 where it meets the swirl chamber 120 may include a curved radius 402 about the circumference of the swirl chamber 120. As can be appreciated, the curved radius 402 may be configured to generally direct any flushed debris or contaminants toward the exit control passage 124, as shown by arrow J, and minimize potential reverse flow of collected debris through the swirl nozzle 202, as shown by arrow K.

It will be appreciated that the drain 100 as generally disclosed herein provides several advantages. For example, the combination of the inlet flow director orifice 110, the swirl nozzle plate 114, and the debris fence 118 allow prolonged operation in severe fouling or plugging service by shunting potential blocking matter away from the smaller downstream flow control passages, such as the exit control passage 124. Also, the compact topology of the swirl nozzle 202, including its unique compound angling, allows the drain 100 to be conveniently contained within a standard piping flange. Moreover, the integration of the annular ring 126 and uniformly-arrayed flushing liquid injection ports 128 disposed about the circumference of the annular ring 126 further extends severe service application of the drain 100, especially in subsea applications. Lastly, the conical endwalls on the swirl chamber 120 actively promote gravity assisted liquid drainage when little or no pressure differential exists across the drain 100, while simultaneously limiting deleterious gas migration through the exit control passage 124. Accordingly, this present disclosure allows reliable and efficient long-term operation of subsea devices requiring drainage maintenance.

Figure 5:
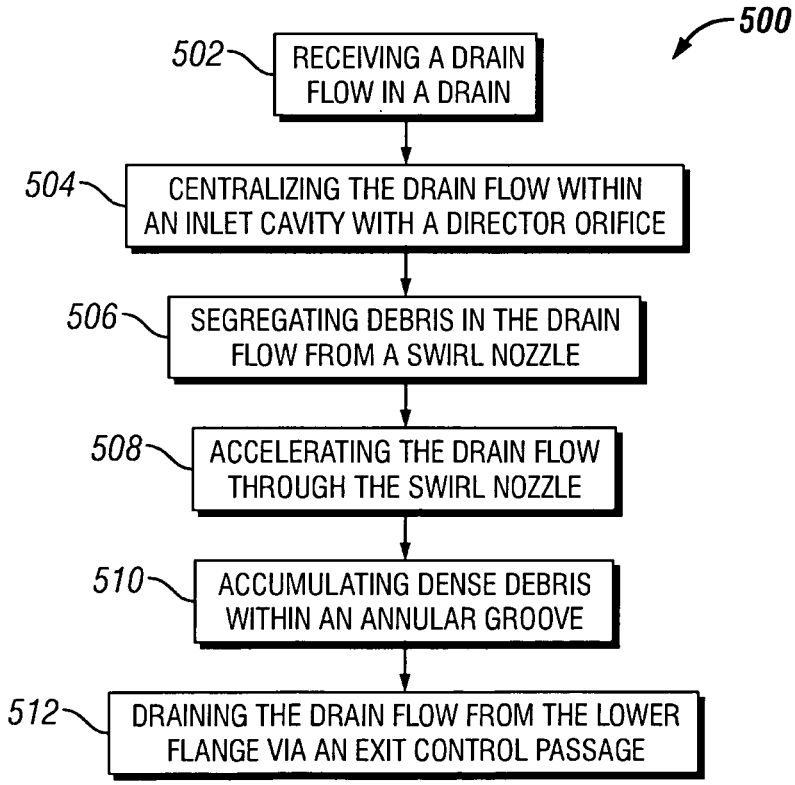
FIG. 5 illustrates a schematic method of controlling a drain flow, according to one or more embodiments of the disclosure.

Referring now to FIG. 5, depicted is a schematic method 500 of controlling a drain flow. The method 500 may include receiving a drain flow in a drain, as at 502. The drain flow may include an upper flange coupled to a lower flange, where the upper flange defines an inlet and the lower flange defines an exit. The drain flow may then be centralized within an inlet cavity with a director orifice, as at 504. The director orifice may be fluidly coupled to the inlet of the upper flange. Any debris within the incoming drain flow may then be segregated from a swirl nozzle, as at 506. The swirl nozzle may be defined within a swirl nozzle plate and provide fluid communication between the inlet cavity and a swirl chamber. The swirl chamber may be defined in the lower flange.

At least a portion of the drain flow may be accelerated through the swirl nozzle to generate a vortical fluid flow, as at 508. The vortical fluid flow may be configured to force any dense debris within the drain flow to a radially outer extent of the swirl chamber. Once separated from the drain flow, the dense debris may accumulate within an annular groove, as at 510. The annular groove may be fluidly coupled to the swirl chamber and defined within the lower flange. The drain flow may then be drained from the lower flange via an exit control passage, as at 512.

As used herein, "about" refers to a degree of deviation based on experimental error typical for the particular property identified. The latitude provided the term "about" will depend on the specific context and particular property and can be readily discerned by those skilled in the art. The term "about" is not intended to either expand or limit the degree of equivalents which may otherwise be afforded a particular value. Further, unless otherwise stated, the term "about" shall expressly include "exactly," consistent with the discussion below regarding ranges and numerical data.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. A controlled flow drain, comprising:

an upper flange coupled to a lower flange, the upper flange defining an inlet fluidly coupled to an upper drain pipe, and the lower flange defining an exit fluidly coupled to a lower drain pipe;

a director orifice fluidly coupled to the inlet of the upper flange and in fluid communication with an inlet cavity defined within the upper flange;

a swirl nozzle plate disposed within the upper flange and configured to receive a drain flow via the inlet and director orifice and accommodate accumulation of debris thereon;

a debris fence coupled to the swirl nozzle plate within the upper flange;

a swirl nozzle defined within the swirl nozzle plate and at least partially surrounded by the debris fence, the swirl nozzle providing fluid communication between the inlet cavity and a swirl chamber;

an annular groove fluidly communicable with the swirl chamber and defined within the lower flange, the annular groove having a series of flushing liquid injection ports symmetrically-arrayed thereabout; and an exit control passage defined within a drain restrictor and in fluid communication with the exit and the lower drain pipe.

2. The controlled flow drain of claim 1, wherein the debris fence segregates the swirl nozzle from the debris accumulating on the swirl nozzle plate.

3. The controlled flow drain of claim 1, wherein the swirl nozzle has a central axis extending from a nozzle inlet to a nozzle outlet.

4. The controlled flow drain of claim 3, wherein the central axis is arranged at an angle $\alpha$ with respect to horizontal, thereby imparting a downward pitch to the swirl nozzle.

5. The controlled flow drain of claim 4, wherein the angle $\alpha$ may be about 20° or less.

6. The controlled flow drain of claim 1, wherein the swirl chamber is defined in the lower flange by a lower surface of the swirl nozzle plate and the drain restrictor.

7. The controlled flow drain of claim 6, wherein the lower surface of the swirl nozzle plate and the drain restrictor are opposing parallel surfaces that are respectively frustoconical.

8. The controlled flow drain of claim 1, wherein the exit control passage includes sharp edges adapted to permit liquid drainage therethrough but concurrently restrict gas carry-under.

9. A method of controlling a drain flow, comprising:

receiving the drain flow into an upper flange coupled to a lower flange, the upper flange defining an inlet and the lower flange defining an exit;

centralizing the drain flow into an inlet cavity defined within the upper flange;

segregating debris within the drain flow from a swirl nozzle defined within a swirl nozzle plate, the swirl nozzle providing fluid communication between the inlet cavity and a swirl chamber defined in the lower flange;

accelerating the drain flow through the swirl nozzle to generate a vortical fluid flow that forces dense debris within the drain flow to a radially outer extent of the swirl chamber;

accumulating the dense debris within an annular groove fluidly coupled to the swirl chamber and defined within the lower flange; and draining the drain flow from the lower flange via an exit control passage.

10. The method of claim 9, further comprising flushing the swirl chamber with a flushing fluid ejected from a series of flushing liquid injection ports symmetrically-arrayed about the annular groove.

11. The method of claim 10, further comprising pressurizing the swirl chamber with the flushing fluid to force the drain fluid through the exit control passage.

12. The method of claim 11, further comprising fluidizing at least a portion of the dense debris such that the dense debris can be drained through the exit control passage.

13. The method of claim 11, further comprising removing built up fouling from the swirl nozzle and exit control passage with the flushing fluid.

14. A controlled flow drain, comprising:

an upper flange coupled to a lower flange, the upper flange defining an inlet fluidly coupled to an upper drain pipe, and the lower flange defining an exit fluidly coupled to a lower drain pipe;

an inlet cavity fluidly coupled to the inlet;

a swirl chamber fluidly coupled to the exit;

a swirl nozzle plate disposed between the inlet cavity and the swirl chamber and having a debris fence coupled thereto, the debris fence being disposed within the inlet cavity;

a swirl nozzle defined within the swirl nozzle plate and providing fluid communication between the inlet cavity and the swirl chamber;

an annular groove defined within the lower flange and in fluid communication with the swirl chamber, the annular groove having a curved radius defined about its upper periphery where the annular groove meets the swirl chamber; and an exit control passage defined within the lower flange and in fluid communication with the exit and the lower drain pipe.

15. The controlled flow drain of claim 14, further comprising a series of flushing liquid injection ports symmetrically-arrayed about the annular groove.

16. The controlled flow drain of claim 15, wherein the swirl nozzle has a central axis arranged at an angle $\alpha$ with respect to horizontal, thereby imparting a downward pitch to the swirl nozzle.

* * * * *